US008179298B2

(12) United States Patent
Sim

(10) Patent No.: US 8,179,298 B2
(45) Date of Patent: May 15, 2012

(54) MULTI-DIRECTIONAL RESONANT-TYPE ELECTROMAGNETIC WAVE ABSORBER, METHOD FOR ADJUSTING ELECTROMAGNETIC WAVE ABSORPTION PERFORMANCE USING THE SAME AND MANUFACTURING METHOD OF THE SAME

(75) Inventor: Dong-Uk Sim, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

(21) Appl. No.: 12/961,226

(22) Filed: Dec. 6, 2010

(65) Prior Publication Data

US 2011/0133978 A1 Jun. 9, 2011

(30) Foreign Application Priority Data

Dec. 7, 2009 (KR) ..... 10-2009-0120443

(51) Int. Cl.
*H01Q 17/00* (2006.01)

(52) U.S. Cl. ..... 342/1; 333/81 R

(58) Field of Classification Search ..... 342/1–4
See application file for complete search history.

(56) References Cited

U.S. PATENT DOCUMENTS

| | | | | |
|---|---|---|---|---|
| 6,538,596 | B1 | 3/2003 | Gilbert | |
| 2003/0158658 | A1 | 8/2003 | Hoever et al. | |
| 2008/0212304 | A1 | 9/2008 | Masuda et al. | |
| 2008/0238684 | A1 * | 10/2008 | Tuttle | 340/572.7 |

FOREIGN PATENT DOCUMENTS

| | | | |
|---|---|---|---|
| EP | 1 255 964 | B1 | 3/2008 |
| KR | 2007-0000483 | A | 1/2007 |

OTHER PUBLICATIONS

Q. Gao et al., "Application of metamaterials to ultra-thin radar-absorbing material design", Electronics Letters, vol. 41, No. 17, Aug. 18, 2005.

D. J. Kern et al., "A Genetic Algorithm Approach to the Design of Ultra-Thin Electromagnetic Bandgap Absorbers", Microwave and Optical Technology Letters, vol. 38, No. 1, Jul. 5, 2003.

* cited by examiner

*Primary Examiner* — Timothy A Brainard
(74) *Attorney, Agent, or Firm* — Rabin & Berdo, PC

(57) ABSTRACT

A multi-directional resonant-type electromagnetic wave absorber includes: at least one ground layer; a first dielectric layer and a second dielectric layer respectively formed on different outer surfaces of the ground layer; a first resistive pattern layer formed on an outer surface of the first dielectric layer; and a second resistive pattern layer formed on an outer surface of the second dielectric layer. Herein, the electromagnetic absorption performance is adjusted by changing one or more of thicknesses, permittivities, and permeabilities of the dielectric layers, thicknesses of the resistive pattern layers, and a reflection coefficient of the ground layer.

20 Claims, 7 Drawing Sheets

MULTI-DIRECTIONAL RESONANT-TYPE ELECTROMAGNETIC WAVE ABSORBER, METHOD FOR ADJUSTING ELECTROMAGNETIC WAVE ABSORPTION PERFORMANCE USING THE SAME AND MANUFACTURING METHOD OF THE SAME

CROSS-REFERENCE(S) TO RELATED APPLICATION(S)

The present invention claims priority of Korean Patent Application No. 10-2009-0120443, filed on Dec. 7, 2009, which is incorporated herein by reference.

FIELD OF THE INVENTION

The present invention relates to a multi-directional resonant-type electromagnetic wave absorber, a method for adjusting electromagnetic wave absorption performance using the same, and a manufacturing method of the same; and, more particularly, to a multi-directional resonant-type electromagnetic wave absorber made of a resistive material, which can absorb electromagnetic waves in a desired frequency band by using an alignment structure composed of a periodic array of a unit cell pattern of an electromagnetic bandgap, a method for adjusting electromagnetic wave absorption performance using the same, and a manufacturing method of the same.

BACKGROUND OF THE INVENTION

As information technology (IT) has been rapidly developed and a human's desire for communication has been increased, wireless communication devices including a portable terminal become necessary articles for the present age. However, as these portable devices have been increasingly used, the influence of electromagnetic waves generated from the terminals on the human body becomes an important issue. The influence of electromagnetic waves at a frequency band used by portable terminals on the human body is not yet clearly found, but it has been reported that the electromagnetic waves may cause various diseases such as leukemia, a brain tumor, a headache, a lowering of eyesight, and when they are accumulated in the human body, confusion of brain waves, destruction of men's reproductive function, and the like. Moreover, cases of malfunctions between information communication devices caused by undesired electromagnetic waves are steadily being reported, and steady research on EMI/EMC problems is under way across the world. Thus, many researches for effectively blocking electromagnetic waves to prevent the bad influences of the electromagnetic waves on the human body are being conducted.

An electromagnetic bandgap (EBG) may be implemented by periodically arranging specifically designed unit cell patterns on a typical electric conductor at regular intervals. Since a tangential component of a magnetic field at a particular band on the surface of the EBG becomes zero, the EBG has the characteristic of preventing current from flowing through the surface. Such an EBG may be regarded as a magnetic conductor opposite to a typical electric conductor. The surface of the EBG is a high-impedance surface (HIS) in configuration of a circuit. The frequency response characteristics of the EBG may be checked through a reflection phase which refers to a difference between the phases of an incident wave on the surface of the EBG and a reflected wave from the surface. The reflection phase of the EBG becomes zero at a resonant frequency corresponding to a high impedance surface and varies in a range from −180 degrees to 180 degrees in a frequency band around the resonant frequency. When the structural parameters of the EBG are adjusted, the reflection phase may vary.

In the structure of a typical EBG, a dielectric layer and an array layer for unit cell patterns other than a metal conductive ground plane constitute the typical structure of a frequency selective surface (FSS). FSS is a surface formed by artificially and periodically arranging specific unit cell patterns so as to selectively transmit or reflect desired frequencies. Therefore, an EBG not only completely blocks the progression of electromagnetic waves but also has the above-described unique physical characteristics, by virtue of providing a metal conductive ground plane for the characteristics of filtering of a specific frequency due to the FSS.

Conventional electromagnetic wave absorbers may be variously classified according to a type, material, absorption mechanism, and the like. To date, most electromagnetic wave absorbers have been made of materials formed to have absorption characteristics. Since such electromagnetic wave absorbers are generally developed after much trial and error, it is disadvantageous in that the manufacturing process thereof is complicated and it is highly difficult to adjust an absorption frequency band and absorption characteristics.

To address this problem, a plate-type resonant electromagnetic wave absorber such as a $\lambda/4$ wave absorber or a Salisbury screen has been proposed, and is composed of a resistive sheet, a dielectric spacer and a metal conductive ground plane. Therefore, such a plate-type resonant electromagnetic wave absorber is advantageous in that, since its configuration is simplified, its manufacture can be facilitated and absorption performance can be easily adjusted, and in that, when it is constructed in multiple layers, multi-band absorption characteristics can be obtained. However, such a Salisbury screen is disadvantageous in that the thickness of the dielectric spacer from the metal conductive ground plane must be more than at least $\lambda/4$.

To implement an electromagnetic wave absorber which is easy to manufacture, makes it easy to adjust an absorption frequency band and absorption characteristics, and can be made thinner, research for a structure of interposing an FSS between the dielectric spacer of the Salisbury screen and the resistive sheet is being carried out.

According to the electromagnetic wave absorber of this structure, the adjustment of thickness and absorption performance is possible owing to the unique electromagnetic properties of the FSS. As a result, an electromagnetic wave absorber formed in this way has a structure formed by adding a resistive coating to the typical structure of the EBG. Furthermore, when the unit cell patterns of the EBG are designed and made of a resistive material on a metal conductor, such a resistive EBG itself may function as a simpler electromagnetic wave absorber. Such an electromagnetic wave absorber may be applied to fields where existing electromagnetic wave absorbers have been applied in order to reduce the multiple reflection of electromagnetic waves, as a simpler structure that is easily manufactured and has low cost. However, this structure has the limitation that only electromagnetic waves in one direction can be absorbed.

SUMMARY OF THE INVENTION

In view of the above, the present invention provides a multi-directional electromagnetic wave absorber which is capable of simultaneously absorbing electromagnetic waves incident in various directions.

Further, the present invention provides a multi-directional electromagnetic wave absorber, which is easy to manufacture, enables the adjustment of thickness, and makes it easy to adjust electromagnetic absorption characteristics of different frequency bands through the adjustment of design parameters by using an electromagnetic bandgap structure and a resistive material.

In accordance with a first aspect of the present invention, there is provided a multi-directional resonant-type electromagnetic wave absorber, including:

at least one ground layer;

a first dielectric layer and a second dielectric layer respectively formed on different outer surfaces of the ground layer;

a first resistive pattern layer formed on an outer surface of the first dielectric layer; and a second resistive pattern layer formed on an outer surface of the second dielectric layer.

In accordance with a second aspect of the present invention, there is provided a method of adjusting electromagnetic absorption performance using a multi-directional resonant-type electromagnetic wave absorber including a ground layer formed of a metal conductor, multiple dielectric layers formed on an outer surface of the ground layer, and resistive pattern layers formed on outer surfaces of the dielectric layers, the method including:

adjusting a absorption bandwidth and a maximum absorption frequency of electromagnetic waves by changing one or more of thicknesses, permittivities, and permeabilities of the dielectric layers, thicknesses of the resistive pattern layers, and a reflection coefficient of the ground layer.

In accordance with a third aspect of the present invention, there is provided a manufacturing method of a multi-directional resonant-type electromagnetic wave absorber, including:

forming a first dielectric layer;

forming at least one ground layer on top of the first dielectric layer;

forming a second dielectric layer on top of the ground layer;

forming a first resistive pattern layer on an outer surface of the first dielectric layer; and forming a second resistive pattern layer on an outer surface of the second dielectric layer.

In accordance with a fourth aspect of the present invention, there is provided a manufacturing method of a multi-directional resonant-type electromagnetic wave absorber, including:

forming a ground layer;

forming a first dielectric layer on top of the ground layer;

forming a second dielectric layer under the ground layer;

forming a first resistive pattern layer on an outer surface of the first dielectric layer; and forming a second resistive pattern layer on an outer surface of the second dielectric layer.

BRIEF DESCRIPTION OF THE DRAWINGS

The objects and features of the present invention will become apparent from the following description of embodiments, given in conjunction with the accompanying drawings, in which.

DETAILED DESCRIPTION OF THE EMBODIMENT

Hereinafter, embodiments of the present invention will be described with reference to the accompanying drawings which form a part hereof.

Figure 1:
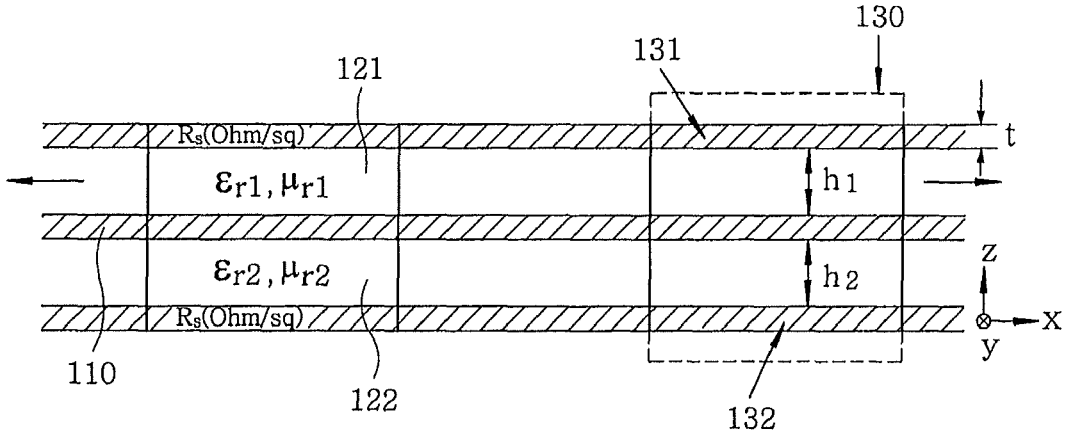
FIG. 1 shows a cross-sectional view of a multi-directional resonant-type electromagnetic wave absorber in accordance with an embodiment of the present invention.

FIG. 1 shows a cross-sectional view of a multi-directional resonant-type electromagnetic wave absorber in accordance with an embodiment of the present invention. The multi-directional resonant-type electromagnetic wave absorber includes at least one ground layer, multiple dielectric layers formed on different outer surfaces of the ground layer, and resistive pattern layers respectively formed on the outer surfaces of the multiple dielectric layers.

Referring to FIG. 1, the resonant-type electromagnetic wave absorber of this embodiment has a first dielectric layer 121 and a first resistive pattern layer 131 that are formed over an inner metal conductive ground layer 110 and a second dielectric layer 122 and a second resistive pattern layer 132 that are formed below the inner metal conductive ground layer 110. The first dielectric layer 121 is formed over the metal conductive ground layer 110, and the first resistive pattern layer 131 is formed over the first dielectric layer 121. Likewise, the second dielectric layer 122 is formed below the metal conductive ground layer 110, and the second resistive pattern layer 132 is formed below the second dielectric layer 122.

The resistive pattern layers 131 and 132 may be composed of an electromagnetic bandgap (EBG) structure in which an EBG unit cell 130 is periodically arranged. Each unit cell 130 includes a unit cell pattern portion where resistive materials are aligned in a specific pattern and a blank portion where unit cell pattern is not formed. Since the EBGs are formed on the surfaces of the dielectric layers 121 and 122, the blank portion may be substantially a dielectric material. Alignment structures and embodiments of the EBG unit cell pattern will be described in detail later.

Figure 2:
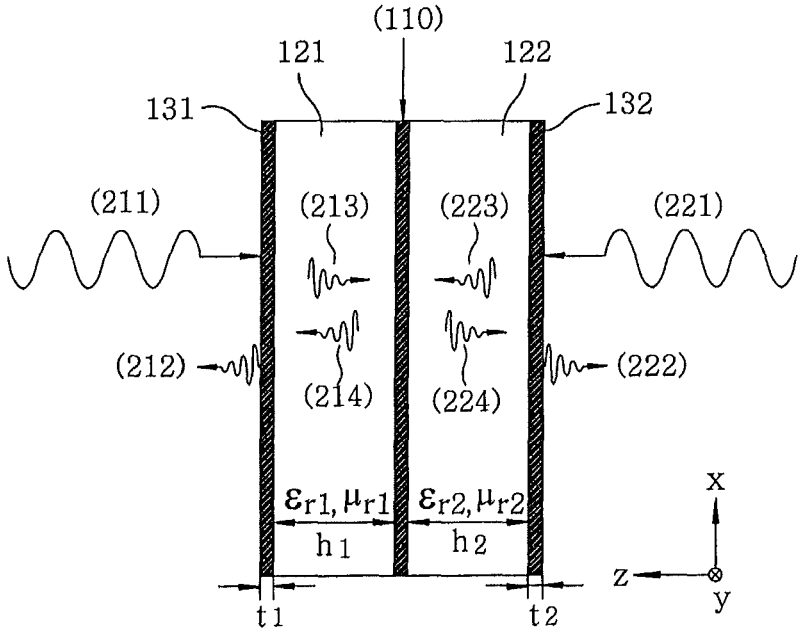
FIG. 2 is a conceptual view illustrating the principle of electromagnetic wave absorption of the multi-directional resonant-type electromagnetic wave absorber in accordance with the present invention.

FIG. 2 is a conceptual view illustrating the principle of electromagnetic wave absorption of the multi-directional resonant-type electromagnetic wave absorber in accordance with the present invention.

The resistive pattern layers 131 and 132 of the resonant-type electromagnetic wave absorber have a structure of incorporating loss into a frequency selective surface (FSS).

The resistive pattern layers 131 and 132 partially reflect (212 and 222) and partially transmit (213 and 223) incident waves 211 and 221 depending on their electromagnetic wave absorption characteristics. The dielectric layers 121 and 122 function to provide a space and medium characteristics so as to adjust the thickness of the entire absorber by interactions between the FSS structure of the resistive pattern layers 131 and 132 and the metal conductive ground layer 110 and adjust the phase of the transmitted waves 213 and 214 and 223 and 224 in the dielectric material depending on a given distance. The metal conductive ground layer 110 functions to totally reflect (214 and 224) the electromagnetic waves 213 and 223 that have been partially transmitted through the resistive pattern layers 131 and 132.

By properly adjusting the phase of the transmitted waves in the dielectric layers 121 and 122 by the interactions between the above parts, the thickness of the absorber can be adjusted, and, as a result, the intensities of entire reflected waves 212 can be reduced due to the loss of the resistive pattern layers 131 and 132. Ideally, if the total reflection coefficient of the resonant-type electromagnetic wave absorber is −1, the incident wave 211 and the reflected wave 212 are completely compensated for, and the resonant-type electromagnetic wave absorber can act as a perfect absorber. The same principle applies to the relationship between the second incident wave 221 and a second surface reflected wave 222.

Electromagnetic wave absorption characteristics, such as electromagnetic absorption bandwidth or maximum absorption frequency, can be adjusted by the thickness h1 and h2 of the dielectric layers 121 and 122 defined as the height from the metal conductive ground plane 110 to the resistive pattern layers 131 and 132, dielectric coefficients $\in_{r1}$ and $\in_{r2}$ and permeability $\mu_{r1}$ and $\mu_{r2}$ which are material characteristics of the dielectric layers 121 and 122, and the thickness t1 and t2 of the resistive pattern layers 131 and 132. In case where the resistive pattern layers 131 and 132 are formed of a periodic array of a unit cell pattern, the electromagnetic absorption characteristics can be adjusted by the shape, surface resistance, and the like of the unit cell pattern.

At this point, if design parameters, shapes, and material characteristics corresponding to every direction are determined to be different values from each other, electromagnetic waves of different frequency bands can be simultaneously absorbed in different directions. For example, if the pattern structure of the first resistive pattern layer 131 and the pattern structure of the second resistive pattern layer 132 are different from each other, a bi-directional electromagnetic wave absorber can be implemented which absorbs electromagnetic waves incident in the direction of the first incident wave 211 at a level below −10 dB in the range of 5.1 GHz to 7.2 GHz and also absorbs electromagnetic waves incident in the direction of the second incident wave 221 at a level below −10 dB in the range of 5.8 GHz to 13 GHz. Also, the direction of the first resistive pattern layer 131 and the direction of the second resistive pattern layer 132 may have different electromagnetic absorption characteristics, even when the dielectric coefficient $\in_{r1}$ of the first dielectric layer 121 and the dielectric coefficient $\in_{r2}$ of the second dielectric layer 122 are different from each other, the thickness h1 of the first dielectric layer 121 and the thickness h2 of the second dielectric layer 122 are different from each other, the permeability $\mu_{r1}$ of the first dielectric layer 121 and the permeability $\mu_{r2}$ of the second dielectric layer 122 are different from each other, or the thickness t1 of the first resistive pattern 131 and the thickness t2 of the second resistive pattern layer 132 are different from each other.

Although this embodiment has been described with respect to a bi-directional electromagnetic wave absorber having one metal conductive ground layer 110, the number of the metal conductive ground layer 110 may be more than one. Further, it may be implemented such that a multi-directional electromagnetic wave absorber has various shapes such as a column, a cylinder, a polygon, a sphere having multiple faces, or different resistive pattern layers coexist on the same plane, being separated by areas.

Figure 3A:
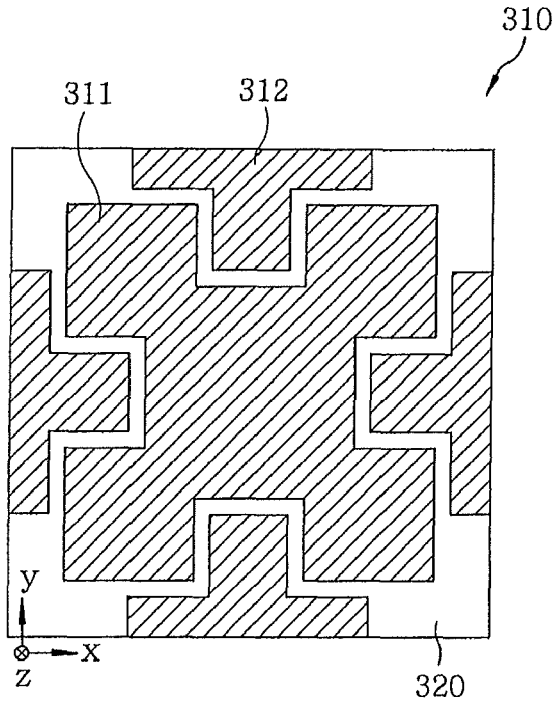
FIG. 3A depicts a top plane view of a unit cell pattern alignment structure used for a multi-directional resonant-type electromagnetic wave absorber.

FIG. 3A illustrates a top plane view of a unit cell pattern alignment structure used for a multi-directional resonant-type electromagnetic wave absorber.

Referring to FIG. 3A, a unit cell 310 having a square shape includes a first unit cell pattern 311 made of a resistive material formed in the unit cell 310 to have a radial symmetric structure with the center of the unit cell 310 as the origin, and four second unit cell patterns 312 formed on each side of the unit cell 310 to have a radial symmetric structure.

Although the unit cell 310 is formed in a square shape in this embodiment, the unit cell 310 may be formed in a variety of different shapes, such as an equilateral triangle, a regular hexagon, and the like. In this embodiment, a blank portion where the unit cell patterns 311 and 312 made of a resistive material are not formed is made of a dielectric material 320. Depending on a surface resistance or an alignment structure such as shape of the unit cell patterns 311 and 312, the electromagnetic wave absorption characteristics of an EBG formed by periodically arranging this unit cell 310 are varied, a description of which will be given in detail later.

Figure 3B:
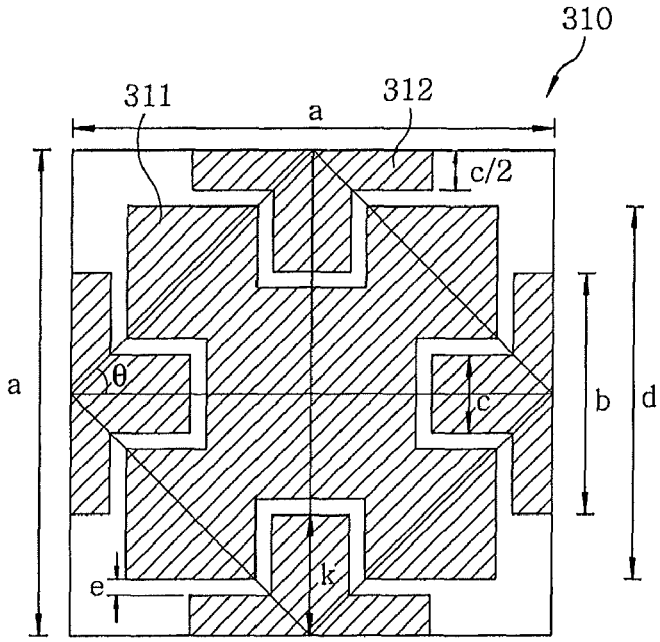
FIG. 3B is a plane view illustrating design parameters of the unit cell pattern alignment structure shown in FIG. 3A.

FIG. 3B is a plane view illustrating design parameters of the unit cell pattern alignment structure shown in FIG. 3A. Referring to FIG. 3B, various design parameters are illustrated such as a length (a) of one side of a square unit cell 310, a length (b) of a side of the second unit cell pattern 312 in contact with the side of the unit cell 310 and a width (c) of a projection portion of the second unit cell pattern 312, a length (d) of the first unit cell pattern 311, an interval (e) between the first unit cell pattern 311 and the second unit cell pattern 312A surface resistance Rs1 of the first unit cell pattern 311 and a surface resistance Rs2 of the second unit cell patterns 312 also may also be used as the design parameters. If the shape of the unit cell 310 is not a square but a rectangle, design parameters, such as a length (k) which is vertical height of the second unit cell pattern 312 from one side of the unit cell 310 or the angle θ of the ratio between the horizontal and vertical lengths of the unit cell 310, may also be used. Even if a unit cell pattern having the same geometric shape is used, the electromagnetic absorption characteristics can be variously adjusted by changing these design parameters.

Figure 4:
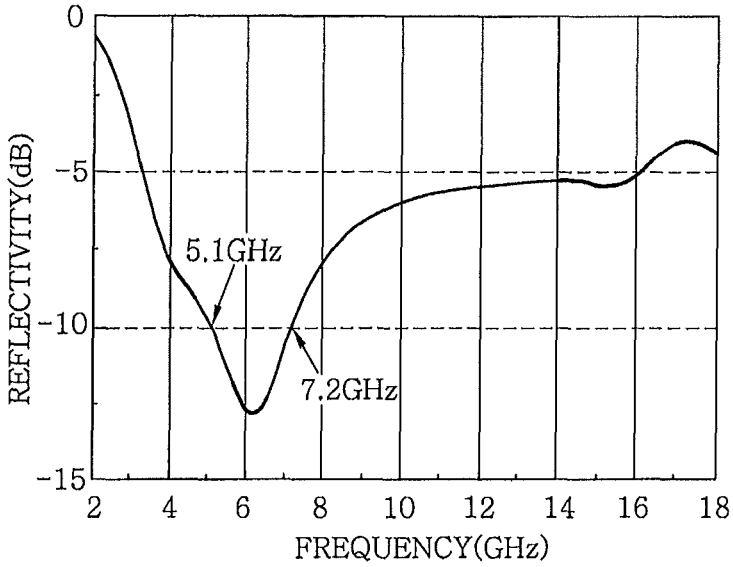
FIG. 4 illustrates the electromagnetic absorption performance for each frequency of one plane of the multi-directional resonant-type electromagnetic wave absorber using the unit cell pattern alignment structure shown in FIG. 3A.

FIG. 4 illustrates the electromagnetic absorption performance for each frequency of one plane of the multi-directional resonant-type electromagnetic wave absorber using the unit cell pattern alignment structure shown in FIG. 3A. In FIG. 4, values, such as Rs=40 [ohm/sq], a=30 [mm], b=15 [mm], c=5 [mm], d=23 [mm], e=1 [mm], h=5 [mm], k=7.5 [mm], t=0.001 [mm], θ=45°, $\in_r$=1, and $\mu_r$=1, are used as the design parameters.

In this case, reflectivity among the absorption performance is defined as follows:

$$R\,[\mathrm{dB}]=20\times\log(r_{DUT}/r_G) \qquad \text{Equation (1)}$$

where R is reflectivity, $r_{DUT}$ is a reflection coefficient of the electromagnetic wave absorber, and $r_G$ is a reflection coefficient of a surface of the metal conductive ground layer.

As to a reference of absorption bandwidth, the reference can be determined as a reflectivity below −1 dB.

In this embodiment, the reference of absorption bandwidth is determined as −10 dB which is a reflectivity for absorbing about 90% of incident waves. Since a frequency band having a reflectivity less than a reference line −10 dB ranges from 5.1 GHz to 7.2 GHz, the frequency absorption band ranges from 5.1 GHz to 7.2 GHz. Moreover, it can be seen that the maximum absorption of electromagnetic waves occur at a reflectivity of about −13 dB near 6 GHz.

Figure 5:
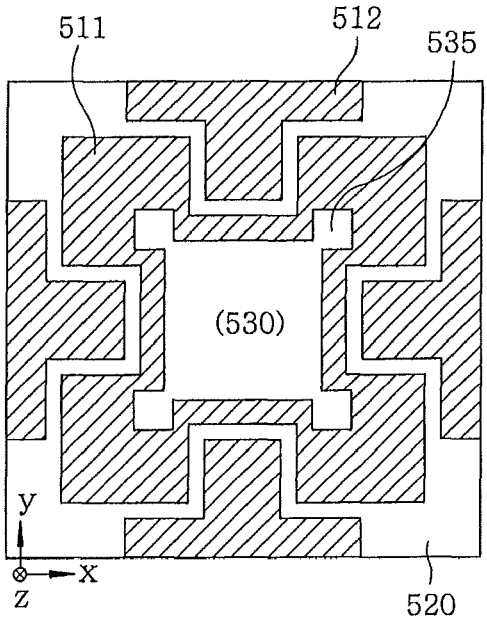
FIG. 5 presents a plane view of a modified unit cell pattern alignment structure of the unit cell pattern alignment structure shown in FIG. 3A.

FIG. 5 shows a plane view of a modified one of the unit cell pattern alignment structure shown in FIG. 3A.

Referring to FIG. 5, it can be seen that the modified unit cell pattern alignment structure further includes a first slot 530 which is a blank formed in a radial symmetric structure inside the first unit cell pattern 511, compared with the unit cell pattern alignment structure of FIG. 3A.

The first slot 530, which is a blank of the first unit cell pattern 511, may be substantially formed of a dielectric material 520. The slot may be formed to be projected and depressed inside the unit cell pattern, corresponding to the radial symmetric projection and depression of the unit cell pattern. In this embodiment, the first slot 530 has a first slot projection 535 corresponding to the projection of the first unit cell pattern 511. Depending on the presence or absence of the projection, the unit cell pattern can be formed in a nearly linear or nearly ring shape. Such a difference is associated with the shape or alignment structure of the unit cell pattern, and has an influence on the electromagnetic absorption performance.

Figure 6:
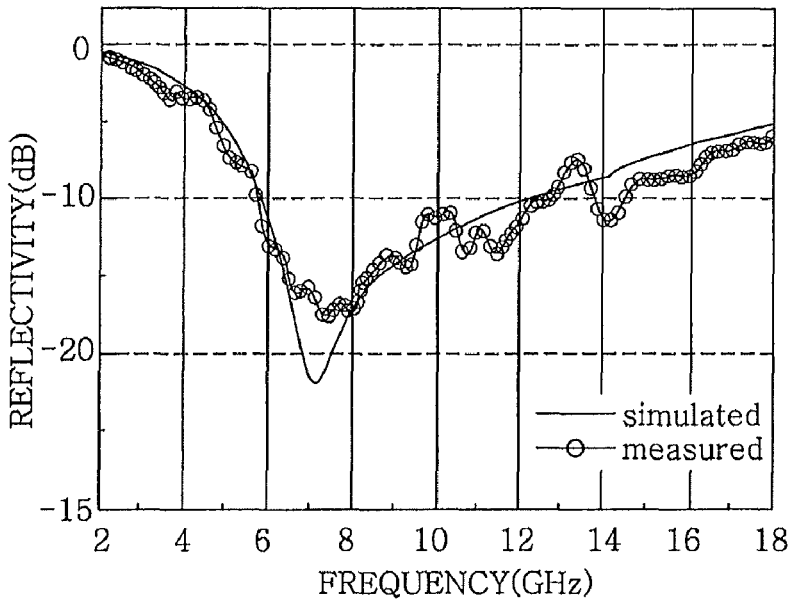
FIG. 6 offers a simulation result and an actual measurement result of electromagnetic absorption performance for each frequency of one plane of the multi-directional resonant-type electromagnetic wave absorber using the unit cell pattern alignment structure shown in FIG. 5.

FIG. 6 shows a simulation result and an actual measurement result of electromagnetic absorption performance for each frequency of one plane of the multi-directional resonant-type electromagnetic wave absorber using the unit cell pattern alignment structure shown in FIG. 5

It can be seen that, according to the simulation result, the electromagnetic absorption bandwidth is about 5.8 GHz to 12.2 GHz and the maximum absorption frequency is about 7.1 GHz, and that, according to the actual measurement result, the electromagnetic absorption bandwidth is about 5.8 GHz to 12.7 GHz and the maximum absorption frequency is about 7.3 GHz. Through these results, it can be concluded that the actual resonant-type electromagnetic wave absorber works almost identically to the prediction by simulation.

When the actual measurement result is compared to a graph of FIG. 4, the maximum absorption frequency has been increased from about 6 GHz to about 7.3 GHz, and the electromagnetic wave absorption bandwidth has been much increased from the range of 5.1 GHz to 7.3 GHz to the range of 5.8 GHz to 12.7 GHz. Such a difference in frequency absorption characteristics is caused by the difference between the unit cell pattern alignment structure of FIG. 3A and the unit cell pattern alignment structure of FIG. 5. Through these results, it can be seen that the electromagnetic absorption characteristics of the resonant-type electromagnetic wave absorber can be adjusted by changes in a unit cell pattern alignment structure.

Figure 7:
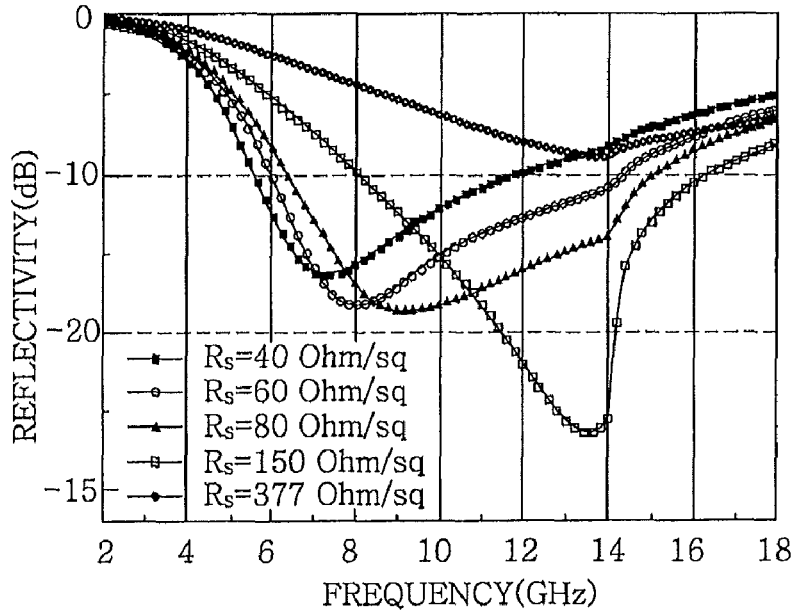
FIG. 7 shows a simulation result of the electromagnetic absorption performance for each frequency that is obtained by changing the surface resistance Rs of the unit cell pattern in the unit cell pattern alignment structure of FIG. 5.

FIG. 7 shows a simulation result of the electromagnetic absorption performance for each frequency that is obtained by changing the surface resistance Rs of the unit cell pattern in the unit cell pattern alignment structure shown in FIG. 5.

Referring to FIG. 7, when the Rs is 40 [Ohm/sq], the frequency absorption bandwidth is about 5.5 GHz to 12 GHz, and when the Rs is 80 [Ohm/sq], the frequency absorption bandwidth is about 6.5 GHz to 15 GHz, whereas, when the Rs is 377 [Ohm/sq], reflectivity below −10 dB is not observed at every frequency, thus making it impossible to absorb more than 90% of a frequency. Through this result, it can be seen that the maximum absorption frequency and the electromagnetic wave absorption bandwidth can be greatly adjusted only by changing the surface resistance Rs of the unit cell pattern.

Figure 8:
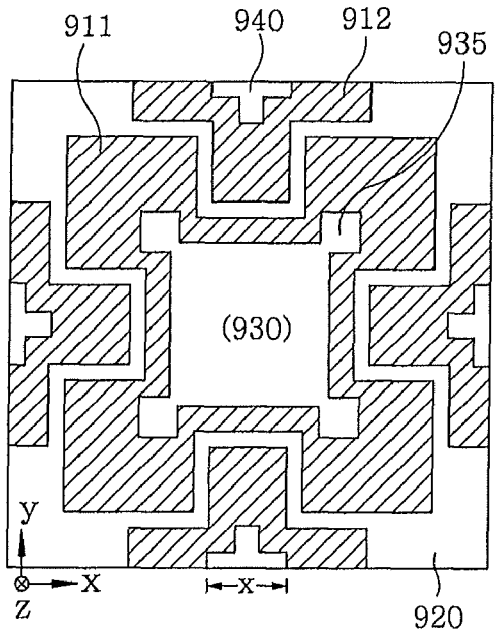
FIG. 8 presents a plane view of a modified one of the unit cell pattern alignment structure shown in FIG. 5.

FIG. 8 depicts a plane view of a modified one of the unit cell pattern alignment structure shown in FIG. 5.

The modified unit cell pattern alignment structure further includes a second slot 940, which is a blank formed in a radial symmetric structure inside a second unit cell pattern 912, compared with the unit cell pattern alignment structure of FIG. 5.

Figure 9:
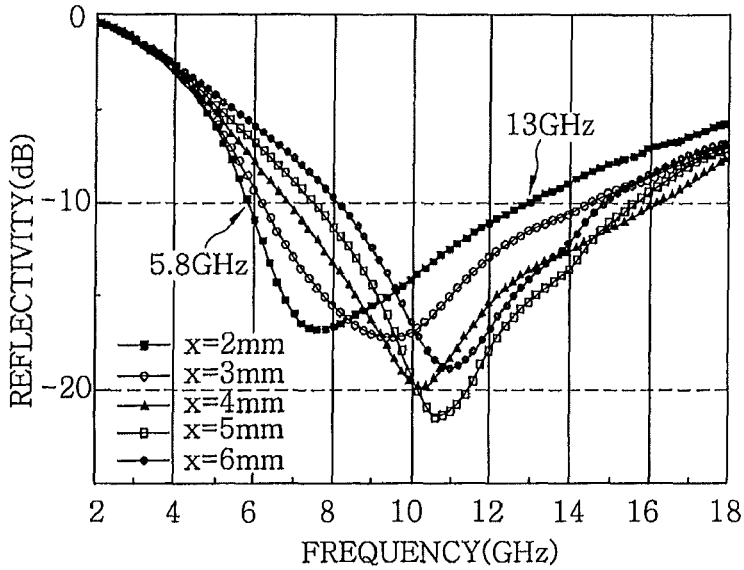
FIG. 9 depicts a simulation result of the electromagnetic absorption performance for each frequency that is obtained by changing a length x of one side of a second slot, which is one of the design parameters of the unit cell pattern alignment structure shown in FIG. 8.

FIG. 9 shows a simulation result of the electromagnetic absorption performance for each frequency that is obtained by changing a length x of one side of the second slot 940, which is one of the design parameters of the unit cell pattern alignment structure shown in FIG. 8.

Referring to FIG. 9, when the length x of one side of the second slot 940 is 2 [mm], the frequency absorption bandwidth is about 5.8 GHz to 13 GHz, when the length is 4 [mm], the frequency absorption bandwidth is about 6.8 GHz to 16.2 GHz, and when the length x is 6 [mm], the frequency absorption bandwidth is about 8.1 GHz to 14.8 GHz. Through these results, it can be seen that electromagnetic absorption performance can be easily adjusted only by simply changing physical design parameters.

Such unit cell structures which can adjust electromagnetic absorption performance by changing the design parameters are used as a basic unit of an EBG-based multi-directional electromagnetic wave absorber, providing the effect of simultaneously absorbing electromagnetic waves of different frequency bands incident in various directions.

Figure 10:
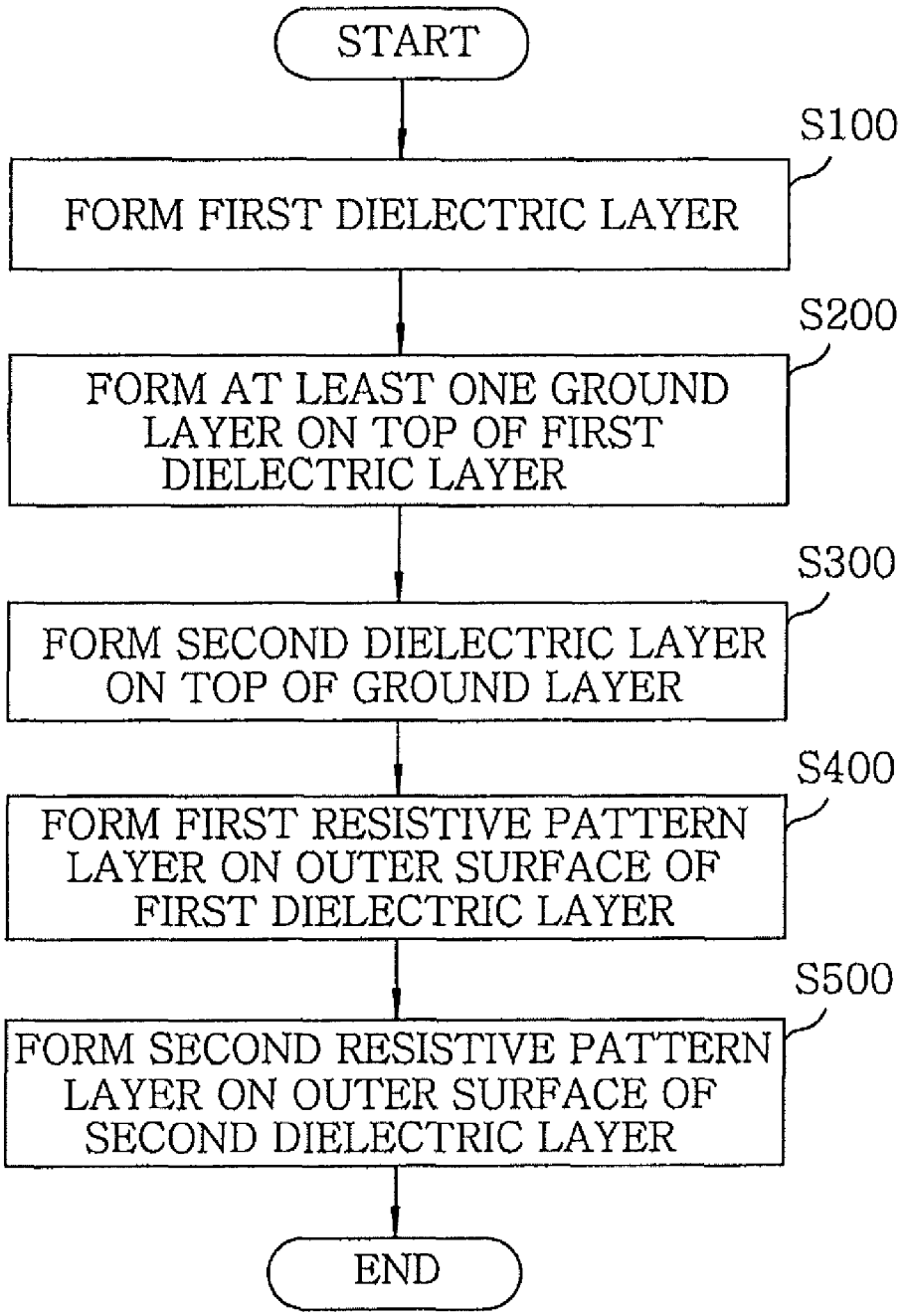
FIG. 10 is a flowchart showing a first embodiment of a manufacturing method of a resonant-type electromagnetic wave absorber.

FIG. 10 is a flowchart showing a first embodiment of a manufacturing method of a resonant-type electromagnetic wave absorber.

Referring to FIG. 10, first, a first dielectric layer 121 is formed in step S100. A thickness, permittivity, and permeability of the first dielectric layer 121 may be determined based on desired electromagnetic absorption characteristics.

Second, at least one ground layer 110 is formed on top of the first dielectric layer 121 in step S200. The ground layer 110 may be formed of a metal conductive material, and the number of the ground layer 110, the reflection coefficient thereof, and the like may be determined based on desired electromagnetic absorption characteristics.

Third, a second dielectric layer 122 is formed on top of the ground layer 110 in step S300. A thickness, permittivity, and permeability of the second dielectric layer 122 may be determined based on desired electromagnetic absorption characteristics.

Fourth, a first resistive pattern layer 131 is formed on an outer surface of the first dielectric layer 121 in step S400. The first resistive pattern layer 131 may be formed by periodically arranging a unit cell pattern made of a resistive material. In accordance with this embodiment, the first resistive pattern layer 131 may be formed in a polygonal shaped unit cell to have a radial symmetric structure with the center of the unit cell as the origin. Herein, a blank having a radial symmetric structure or a slot made of a dielectric material may be formed in the unit cell pattern.

Fifth, a second resistive pattern layer 132 is formed on an outer surface of the second dielectric layer 122 in step S500. The second resistive pattern layer 132 may be also formed by periodically arranging a unit cell pattern made of a resistive material. Likewise, in accordance with this embodiment, the second resistive pattern layer 132 may be formed in a polygonal shaped unit cell to have a radial symmetric structure with the center of the unit cell as the origin. Further, a blank having a radial symmetric structure or a slot made of a dielectric material may be formed in the unit cell pattern.

In accordance with this embodiment, the first resistive pattern layer 131 and the second resistive pattern layer 132 may be formed such that they differ from each other in one or more of thickness, the shape of the unit cell pattern, and the surface resistance of the unit cell pattern.

Figure 11:
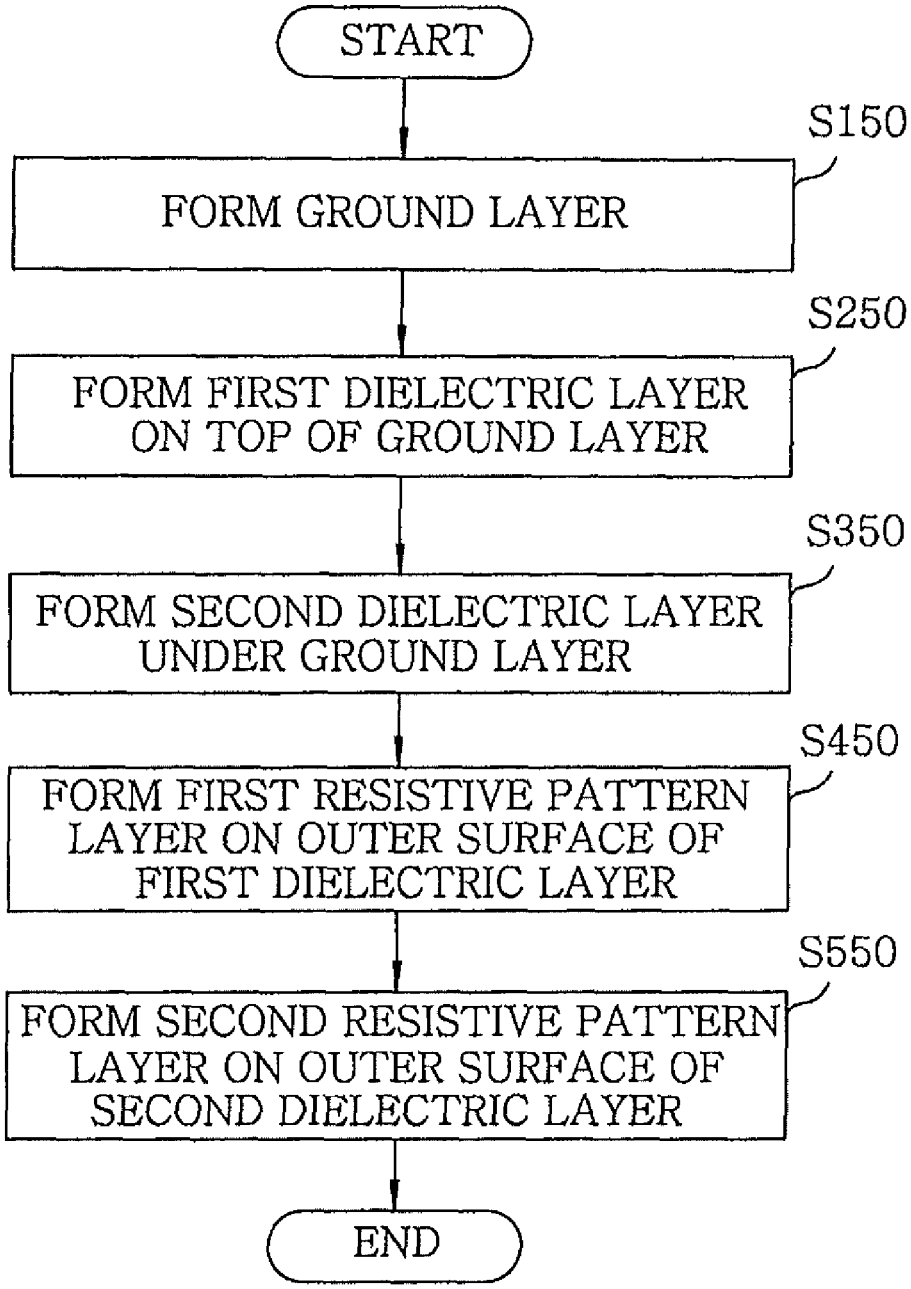
FIG. 11 is a flowchart showing a second embodiment of a manufacturing method of a resonant-type electromagnetic wave absorber.

FIG. 11 is a flowchart showing a second embodiment of a manufacturing method of a resonant-type electromagnetic wave absorber in accordance with the present invention.

Referring to FIG. 11, a ground layer 110 is formed in step S150. After that, a first dielectric layer 121 is formed on top of the ground layer 110 in step S250, and then a second dielectric layer 122 is formed under the ground layer 110 in step S350. Next, a first resistive pattern layer 131 is formed on an outer surface of the first dielectric layer 121 in step S450, and a second resistive pattern layer 132 is formed on an outer surface of the second dielectric layer 122 in step S550. A detailed process of the manufacturing method of the second embodiment may be performed in the same way as that of the manufacturing method of the first embodiment.

In accordance with the present invention, electromagnetic waves incident in various directions can be simultaneously absorbed by using a multi-directional electromagnetic wave absorber.

Moreover, the manufacturing process of the multi-directional electromagnetic wave absorber can be performed easier.

Further, the thickness of the multi-directional electromagnetic wave absorber can be controlled, while electromagnetic absorption characteristics of different frequency bands are easily adjusted by changing design parameters.

While the invention has been shown and described with respect to the embodiments, it will be understood by those skilled in the art that various changes and modification may be made without departing from the scope of the invention as defined in the following claims.

What is claimed is:

1. A multi-directional resonant-type electromagnetic wave absorber, comprising:

at least one ground layer;

a first dielectric layer and a second dielectric layer respectively formed on different outer surfaces of the ground layer;

a first resistive pattern layer formed on an outer surface of the first dielectric layer; and a second resistive pattern layer formed on an outer surface of the second dielectric layer.

2. The multi-directional resonant-type electromagnetic wave absorber of claim 1, wherein the first resistive pattern layer and the second resistive pattern layer is formed by periodically arranging a unit cell pattern made of a resistive material.

3. The multi-directional resonant-type electromagnetic wave absorber of claim 2, wherein the first resistive pattern layer and the second resistive pattern layer differ from each other in one or more of thickness, a shape of the unit cell pattern, and the surface resistance of the unit cell pattern.

4. The multi-directional resonant-type electromagnetic wave absorber of claim 2, wherein the unit cell pattern is formed in a polygonal shaped unit cell to have a radial symmetric structure with the center of the unit cell as the origin.

5. The multi-directional resonant-type electromagnetic wave absorber of claim 4, wherein the unit cell pattern includes:

a first unit cell pattern formed in the unit cell to have the radial symmetric structure; and multiple second unit cell patterns formed on each side of the unit cell to have the radial symmetric structure.

6. The multi-directional resonant-type electromagnetic wave absorber of claim 4, wherein the unit cell pattern further includes therein a blank having the radial symmetric structure or a slot made of a dielectric material.

7. The multi-directional resonant-type electromagnetic wave absorber of claim 6, wherein the slot is projected and depressed inside the unit cell pattern, corresponding to projections and depressions in the radial symmetric structure of the unit cell pattern.

8. The multi-directional resonant-type electromagnetic wave absorber of claim 4, wherein the polygonal shape is one of an equilateral triangle, a square, and a regular hexagon.

9. The multi-directional resonant-type electromagnetic wave absorber of claim 1, wherein the first dielectric layer and the second dielectric layer differ from each other in one or more of thicknesses, permittivities, and permeabilities; and one or more of the thickness, permittivity, and permeability of the first dielectric layer or the second dielectric layer, thicknesses of the resistive pattern layers, and reflection coefficients of the surfaces of the ground layer are determined such that reflectivity of electromagnetic waves within a predetermined absorption bandwidth on the surface of the electromagnetic wave absorber have a predetermined value below −1 dB.

10. The multi-directional resonant-type electromagnetic wave absorber of claim 1, wherein the ground layer is formed of one metal conductor and totally reflects the electromagnetic waves that have been transmitted through the first dielectric layer or the second dielectric layer, and the first resistive pattern layer and the second resistive pattern layer are formed to be planar and absorb electromagnetic waves from both directions of the outer surface of the first resistive pattern layer and the outer surface of the second resistive pattern layer.

11. A method of adjusting electromagnetic absorption performance using a multi-directional resonant-type electromagnetic wave absorber including a ground layer formed of a metal conductor, multiple dielectric layers formed on an outer surface of the ground layer, and resistive pattern layers formed on outer surfaces of the dielectric layers, the method comprising:

adjusting a absorption bandwidth and a maximum absorption frequency of electromagnetic waves by changing one or more of thicknesses, permittivities, and permeabilities of the dielectric layers, thicknesses of the resistive pattern layers, and a reflection coefficient of the ground layer.

12. The method of claim 11, wherein the absorption bandwidth and the maximum absorption frequency of electromagnetic waves are adjusted by further changing one or more of a shape of a unit cell pattern made of a resistive material that is periodically arranged so as to form the resistive pattern layers, or surface resistance of the unit cell pattern.

13. The method of claim 12, wherein the unit cell pattern is formed in a polygonal shaped unit cell to have a radial symmetric structure with the center of the unit cell as the origin, and includes therein a blank having the radial symmetric structure or a slot made of a dielectric material, and wherein a change in the shape of the unit cell pattern is made by changing a length of each side of the unit cell or the slot.

14. The method of claim 11, wherein the absorption bandwidth and the maximum absorption frequency of electromagnetic waves are adjusted such that reflectivity of electromagnetic waves within a predetermined absorption bandwidth on the surface of the electromagnetic wave absorber has a predetermined value below −1 dB.

15. A manufacturing method of a multi-directional resonant-type electromagnetic wave absorber, comprising:

forming a first dielectric layer;

forming at least one ground layer on top of the first dielectric layer;

forming a second dielectric layer on top of the ground layer;

forming a first resistive pattern layer on an outer surface of the first dielectric layer; and forming a second resistive pattern layer on an outer surface of the second dielectric layer.

16. The manufacturing method of claim 15, wherein the first resistive pattern layer and the second resistive pattern layer are formed by periodically arranging a unit cell pattern made of a resistive material, and formed to be different from each other in one or more of thickness, a shape of the unit cell pattern, and a surface resistance of the unit cell pattern.

17. The manufacturing method of claim 16, wherein the unit cell pattern is made of a resistive material in a polygonal shaped unit cell to have a radial symmetric structure with the center of the unit cell as the origin and includes therein a blank having the radial symmetric structure or a slot made of a dielectric material.

18. A manufacturing method of a multi-directional resonant-type electromagnetic wave absorber, comprising:

forming a ground layer;

forming a first dielectric layer on top of the ground layer;

forming a second dielectric layer under the ground layer;

forming a first resistive pattern layer on an outer surface of the first dielectric layer; and forming a second resistive pattern layer on an outer surface of the second dielectric layer.

19. The manufacturing method of claim 18, wherein the first resistive pattern layer and the second resistive pattern layer are formed by periodically arranging a unit cell pattern made of a resistive material, and formed to be different from each other in one or more of thickness, a shape of the unit cell pattern, and a surface resistance of the unit cell pattern.

20. The manufacturing method of claim 19, wherein the unit cell pattern is made of a resistive material in a polygonal shaped unit cell to have a radial symmetric structure with the center of the unit cell as the origin and includes therein a blank having the radial symmetric structure or a slot made of a dielectric material.

* * * * *